US008327775B2

(12) United States Patent
Fox Harris

(10) Patent No.: US 8,327,775 B2
(45) Date of Patent: Dec. 11, 2012

(54) TRANSPORT PALLET

(76) Inventor: Philip John Fox Harris, Fareham (GB)

( * ) Notice: Subject to any disclaimer, the term of this patent is extended or adjusted under 35 U.S.C. 154(b) by 297 days.

(21) Appl. No.: 12/557,447

(22) Filed: Sep. 10, 2009

(65) Prior Publication Data

US 2010/0116178 A1 May 13, 2010

(30) Foreign Application Priority Data

Sep. 16, 2008 (GB) ..... 0816922.9
Dec. 22, 2008 (GB) ..... 0823297.7

(51) Int. Cl.
*B65D 19/38* (2006.01)

(52) U.S. Cl. ..... 108/53.3; 108/53.5; 108/55.1

(58) Field of Classification Search ..... 108/55.1, 108/55.3, 55.5, 53.5, 51.11, 53.1, 53.3, 56.1, 108/56.3, 57.17, 57.32; 206/386, 595, 597–600
See application file for complete search history.

(56) References Cited

U.S. PATENT DOCUMENTS

| | | | | | |
|---|---|---|---|---|---|
| 3,147,860 | A * | 9/1964 | Kean, Sr. et al. | ..... | 206/448 |
| 3,499,398 | A * | 3/1970 | Murray | ..... | 108/53.5 |
| 3,724,398 | A * | 4/1973 | Brennan | ..... | 108/56.3 |
| 3,753,407 | A * | 8/1973 | Tilseth | ..... | 108/53.3 |
| 3,857,494 | A * | 12/1974 | Giardini | ..... | 211/194 |
| 3,945,501 | A * | 3/1976 | Jay | ..... | 211/194 |
| 4,773,547 | A * | 9/1988 | Bell | ..... | 211/194 |
| 5,411,360 | A * | 5/1995 | Hilliker et al. | ..... | 414/608 |
| 5,727,920 | A * | 3/1998 | Hull et al. | ..... | 414/476 |
| 6,364,142 | B1 * | 4/2002 | Kaspar | ..... | 212/231 |
| 6,902,074 | B2 * | 6/2005 | Albrecht | ..... | 211/189 |
| 6,905,021 | B2 * | 6/2005 | Polumbaum et al. | ..... | 206/386 |
| 6,976,434 | B2 * | 12/2005 | Roig et al. | ..... | 108/25 |
| 7,152,749 | B2 * | 12/2006 | Beck | ..... | 211/194 |
| 7,267,060 | B1 * | 9/2007 | Moser et al. | ..... | 108/53.1 |
| 7,918,165 | B2 * | 4/2011 | Owen | ..... | 108/55.1 |
| 2007/0059119 | A1 * | 3/2007 | Hadar | ..... | 410/46 |
| 2010/0175596 | A1 * | 7/2010 | Scheetz | ..... | 108/55.1 |
| 2011/0303129 | A1 * | 12/2011 | Harris | ..... | 108/53.1 |

FOREIGN PATENT DOCUMENTS

DE 2847818 * 5/1980

* cited by examiner

*Primary Examiner* — Janet M Wilkens
(74) *Attorney, Agent, or Firm* — Jennifer Meredith, Esq.; Meredith & Keyhani, PLLC

(57) ABSTRACT

A transport pallet is provided with a chassis including feet on its underside from providing space for lifting using a fork lift truck or the like. The chassis is also provided with receptacles in the chassis for corner posts erectable at the corners of the chassis. The corner posts may also be provided with cross-members for increased stability. When not in use the corner posts and cross-members can be stowed in channels in the chassis, with the channels, posts and cross-members being color coded for ease of identification. The chassis can also be provided with straps for securing of the load.

5 Claims, 12 Drawing Sheets

TRANSPORT PALLET

BACKGROUND OF THE INVENTION

This application claims priority to application number 0816922.9 filed Sep. 16, 2008 in the United Kingdom and application number 0823297.7 filed Dec. 22, 2008 in the United Kingdom.

The present invention relates to a transport pallet.

Wooden pallets are very widely used. Essentially they comprised a boarding platform and blocks to hold the platform off the ground/load-bed/deck (as the case may be) and allow the forks of a forklift truck or the like to pass under the platform to lift the platform and its load.

When relatively light goods, such as boxed fruit, are to be transported on a pallet, some form of strapping is required of the goods to the pallet, to hold the goods compact and allow the pallets to be stowed tightly as in a container. Often so-called corner boards are used at the corners of the goods stack on the pallet. Strapping around the corner board holds the boxes compact on the pallet. Corner boards are normally extruded with a right angle section from recycled plastics material. Their material is such that further recycling is not practical. Costly and environmentally unfriendly land fill disposal is the usual expedient.

The object of the present invention is to provide an improved transport pallet, in particular for corner boards and the like, but also for any other goods.

BRIEF DESCRIPTION OF THE INVENTION

According to the invention there is provided a transport pallet comprising:

- a chassis;
- feet for supporting the chassis with a lifting fork space beneath the chassis;
- receptacles in the chassis for corner posts erectable at the corners of the chassis, the posts being completely below the top surface of the chassis when stowed in the receptacles.

Provision of a top surface un-interrupted by the corners posts protruding from their receptacles enables the pallet to be used as a conventional pallet for journeys in one direction and to be used for a stack of corner boards or other goods, the corner posts erected, for return journeys. Of course the pallet can be used with or without the corner posts erected for any journey depending upon the cargo.

Normally:

- the chassis will have sockets at corner for receiving either lower ends of the posts or the feet of another such pallet stacked on top with or without the posts being erected;
- the posts will have upper ends adapted to receive the feet of another such pallet stacked on top or engage with the ends of cross-members interconnecting the posts in pairs, the cross-members being adapted to receive the feet of another such pallet stacked on top;
- the chassis will be provided with straps for strapping a load of corner boards to the chassis.

In the preferred embodiment, the interior space of the chassis is divided into a number of slot-like compartments for the posts and the cross-members.

Conveniently, the slots on the one hand and the posts and cross-members on the other hand are colour coded to help with stowage in the correct slots.

Conveniently, the chassis may be provided with gripper rods having teeth to increase friction and assist in holding the goods securely on the pallet.

The base of the chassis may also be provided with a grill to allow for storage of the strap when not in use or other items. The grill also provided attachment points for additional straps or the like, if considered necessary in use.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE INVENTION

Figure 1:
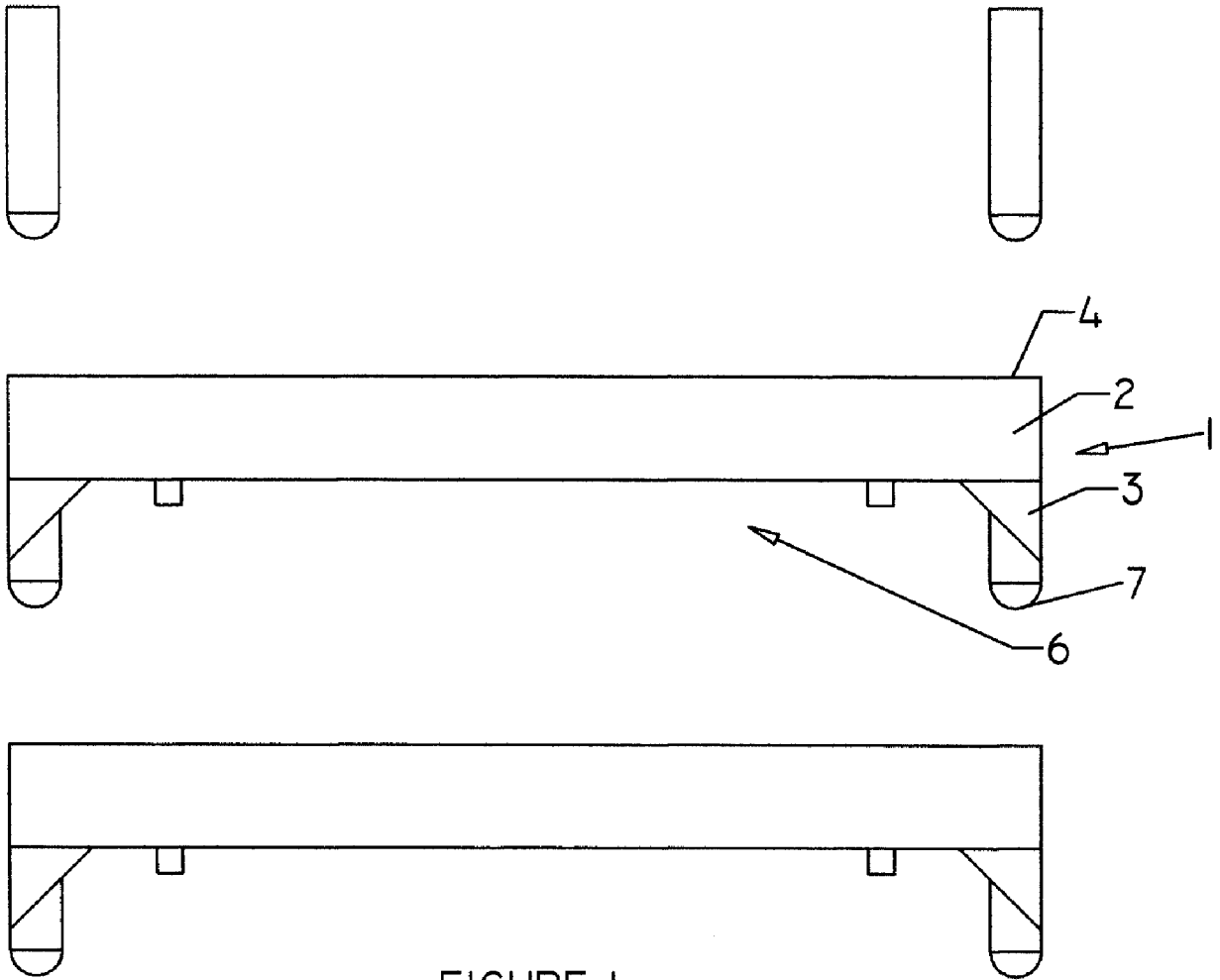
FIG. 1 is a front view of a pallet according to the invention.
Figure 2:
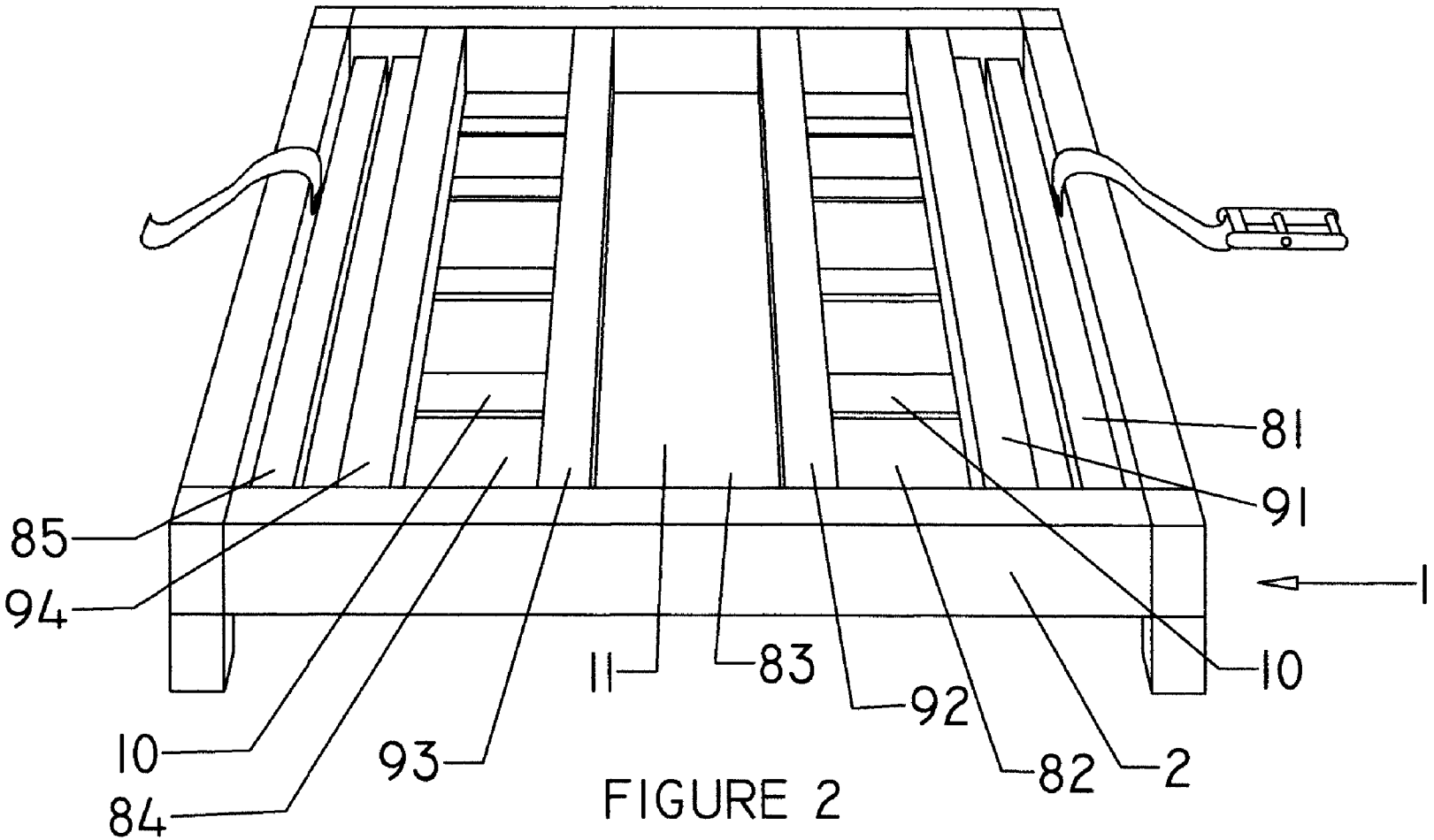
FIG. 2 is a top view of the pallet of FIG. 1.

Referring to FIGS. 1 and 2 of the drawings, the transport pallet 1 there shown is of steel box section side members 2, with corner tubes 3 arranged to provide upwardly open sockets 4. Below the corner tubes extend down below the side members to leave a fork lift pallet gap 6. The tubes have rounded feet 7, which are shaped to locate in the sockets of another pallet.

Figure 3:
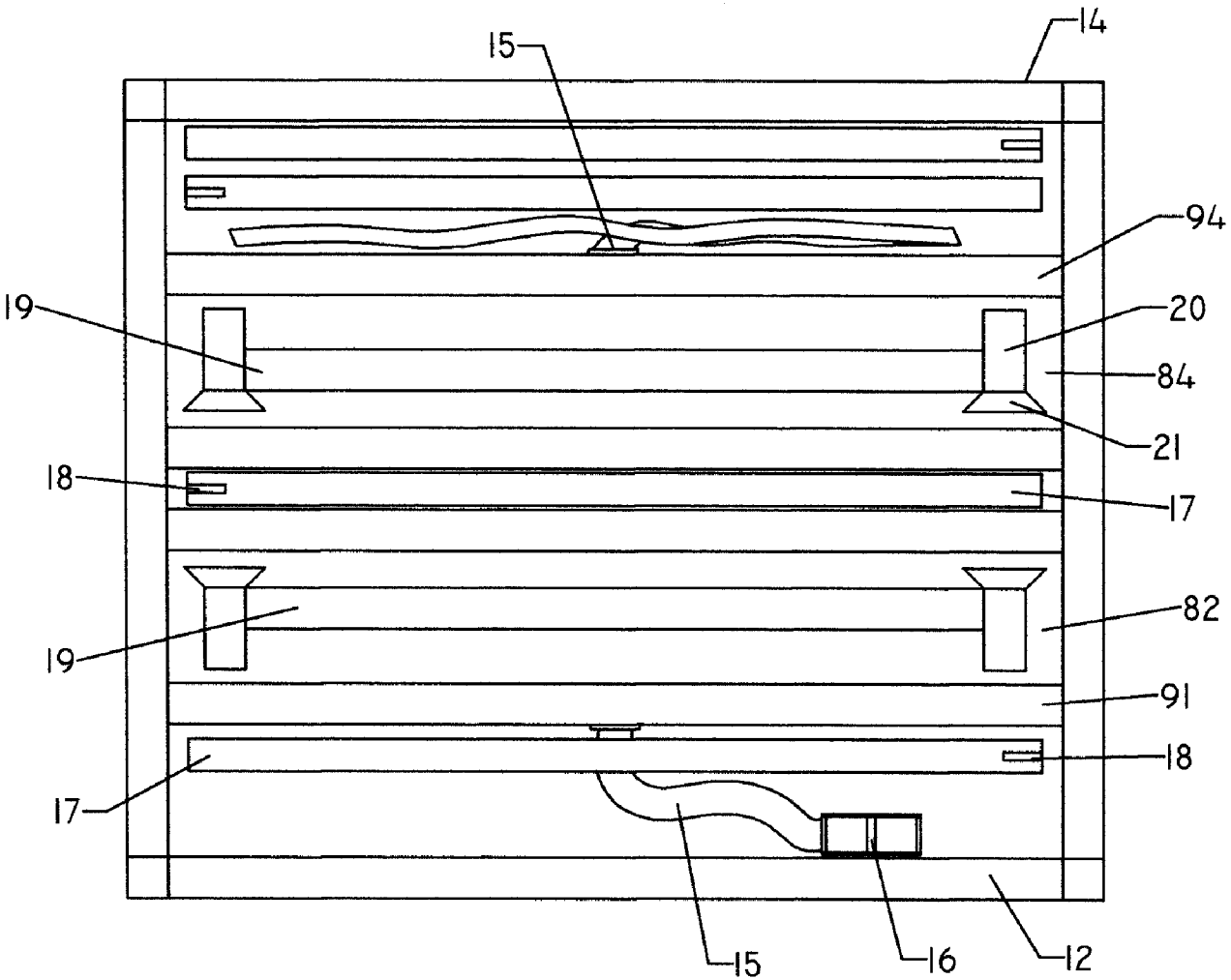
FIG. 3 is a top view of the pallet of FIG. 1 including stowed corner posts.

Turning now to FIGS. 2 and 3, the interior of the pallet, between the side members 2 is divided into five parallel, slot-like compartments 81, 82, 83, 84, 85, by four additional, box-section member dividers 91, 92, 93, 94. All of the box section members and the corner tubes are flush at the top of the pallet. Strips 10 extend between box section members on the bottom of the pallet and provide supports for boards 11 closing the bottom of the compartments.

The additional box section members 91, 94 nearest to the sides of the pallet have respective ends 12, 14 of a strap 15 attached to them. The strap has a ratchet 16. Within the compartments are received for stowage four corner posts, 17, of a size to fit in the corner tubes 3, with a tab 18 limiting the depth of engagement of the posts in the tubes.

The compartment 81 having the ratchet 16 has space for a single post. The opposite compartment 85 with the loose strap 15 has two posts. A narrow central compartment 83 houses a single post. The intermediate compartments 82,84 house cross-members 19, which are the same length as the short side of the pallet. At their ends, the cross-members have tubular sockets 20, which fit over the tubes and are provided with cups 21. These are wide and the boards in the compartments 82,84 are cut away at one side, to allow the cups to fit in without projecting above the top surface of the pallet. The cups are complementary to the feet 7, allowing pallets with posts to be stacked one on another.

The posts and the cross-members and their respective compartments are colour coded, to ensure that when the pallet is disassembled from its erected state, the correct parts are readily placed in the correct compartments.

Figure 4:
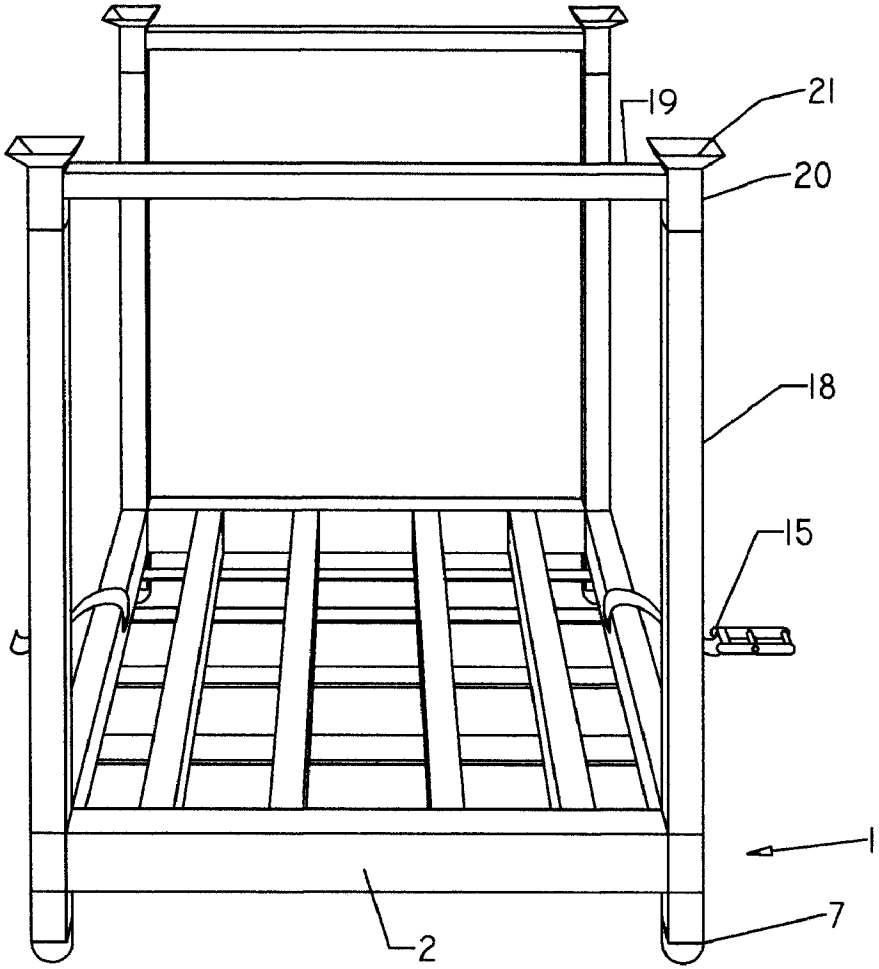
FIG. 4 is a front view of an empty pallet with corner posts erected.

Referring to FIG. 4, the pallet 1 thereshown is fitted with corner posts 17. These enable the contents of the pallet to be secured in place. On top of the corner posts are cross members 19, with tubular sockets 20 and cups 21, ready to receive a further pallet.

Figure 5:
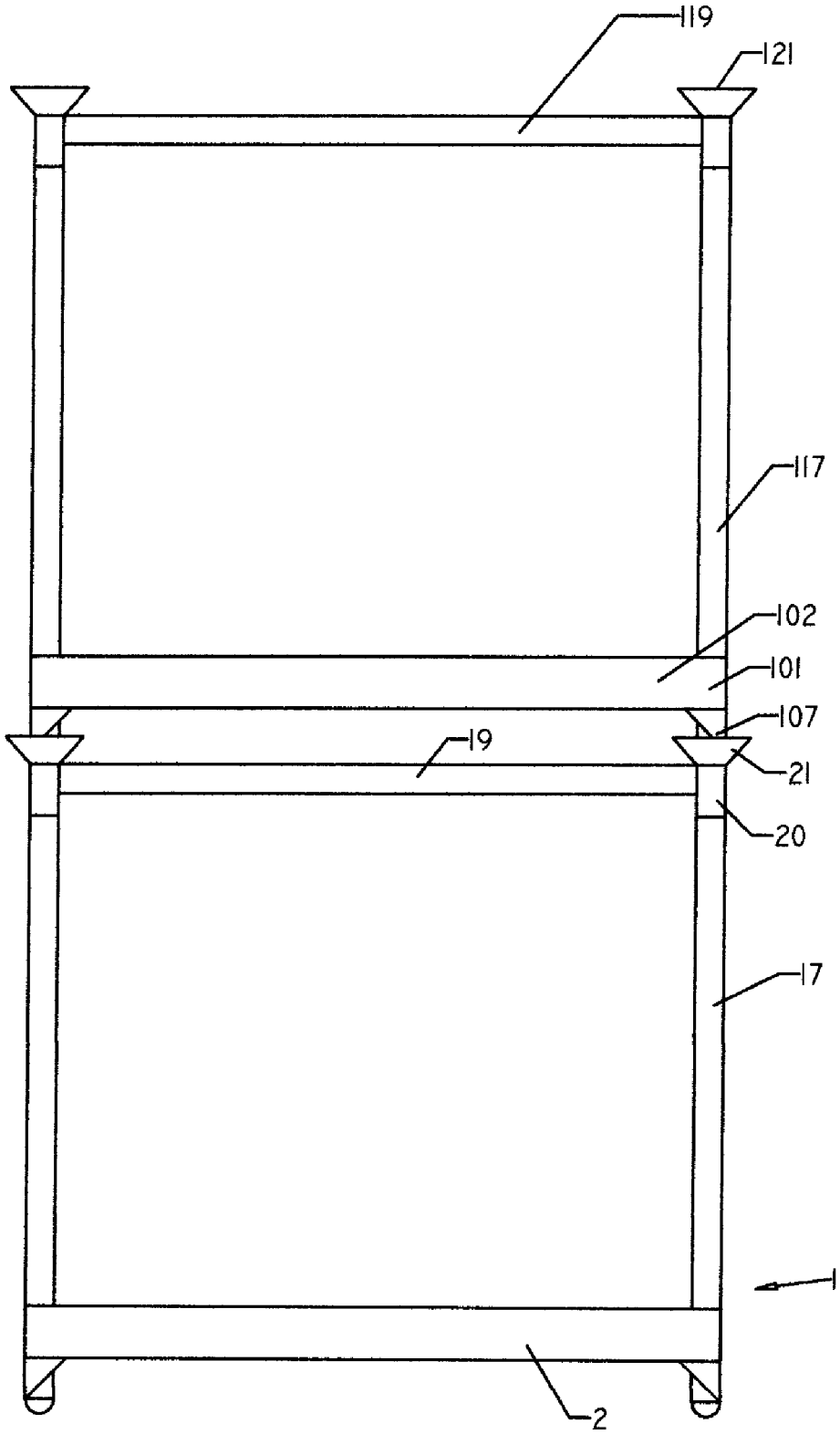
FIG. 5 is a front view of two pallets stacked on top of each other.

Turning now to FIG. 5, a second pallet 101 is shown stacked on top of the first pallet 1, with the feet 107 of the second pallet 101 fitting in side the cups 21 on the sockets 20 on the first pallet. The second pallet is identical to the first, being provided with a side members 102, corner posts 117, cross-member 119 and cups 121.

Figure 6:
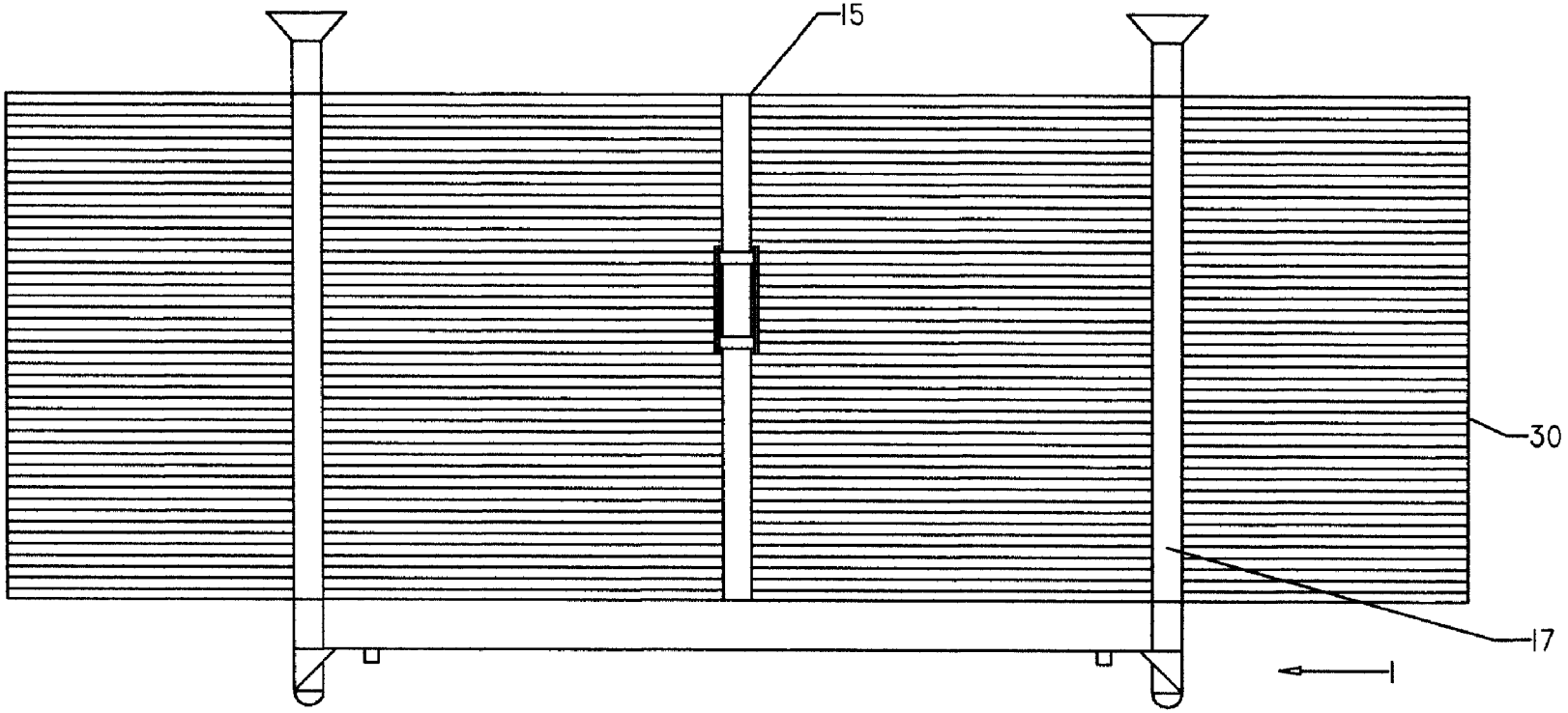
FIG. 6 is a side view of a pallet fully loaded with corner boards.
Figure 7:
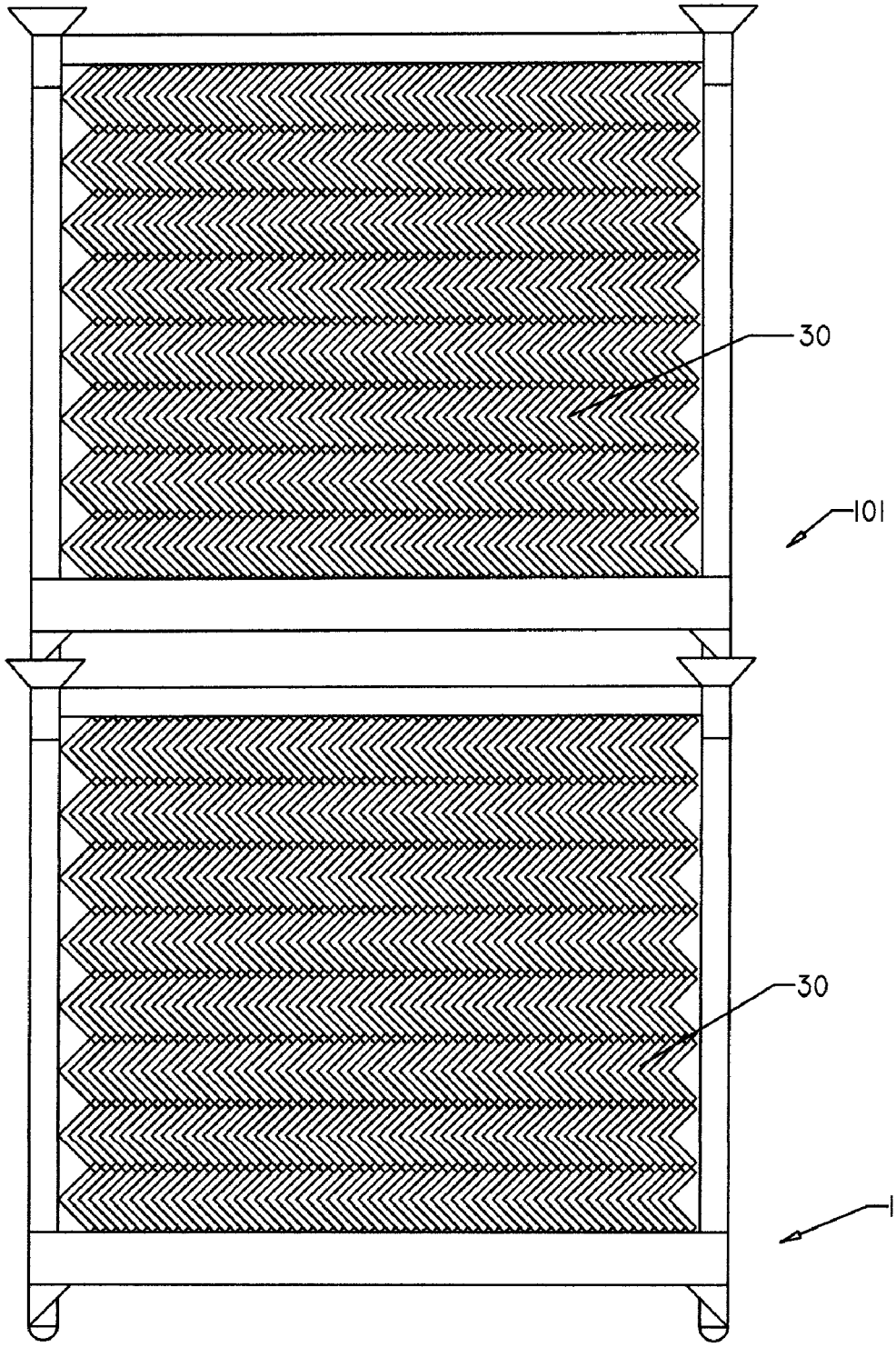
FIG. 7 is a front view of two pallets full loaded with corner boards.

FIG. 6 shows a pallet 1 fully loaded with corner boards 30. The pallet is provided with corner posts 17 to contain the load, which are further held in place with the straps 15, connected to the compartments in the pallet 1. FIG. 7 shows a second pallet 101 stacked on top of a first pallet 1, both pallets loaded with corner boards 30.

Figure 8:
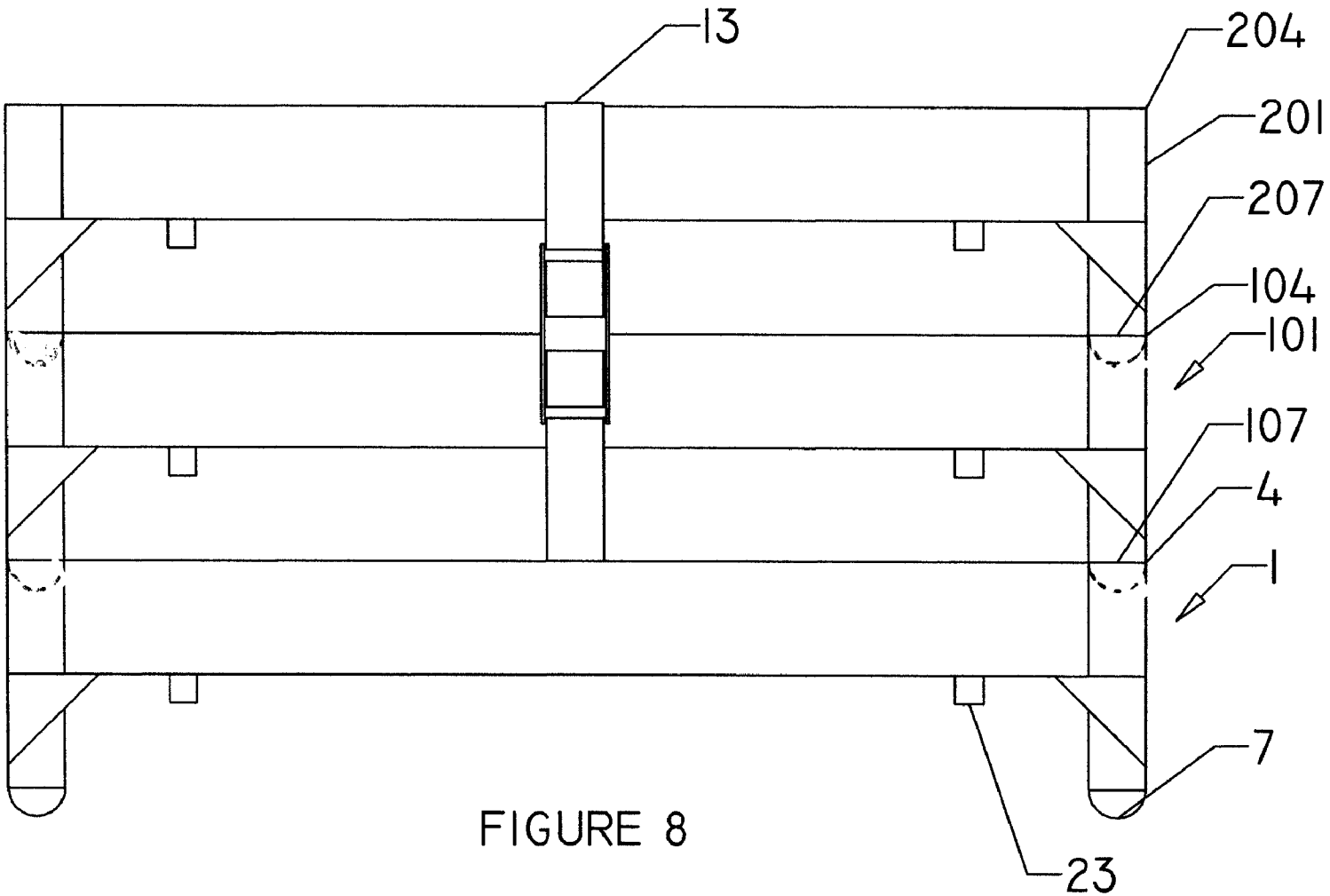
FIG. 8 is a side view of stacked pallets.

When not in use the pallets can be stacked for easy transportation. FIG. 8 shows a stack of pallets, 1, 101, 201, held together by the straps 15 from the first pallet 1. The feet 107, 207, of the upper pallets, 101, 201, fitting into the sockets 4, 104 in the lower pallets, 1, 101.

Figure 9:
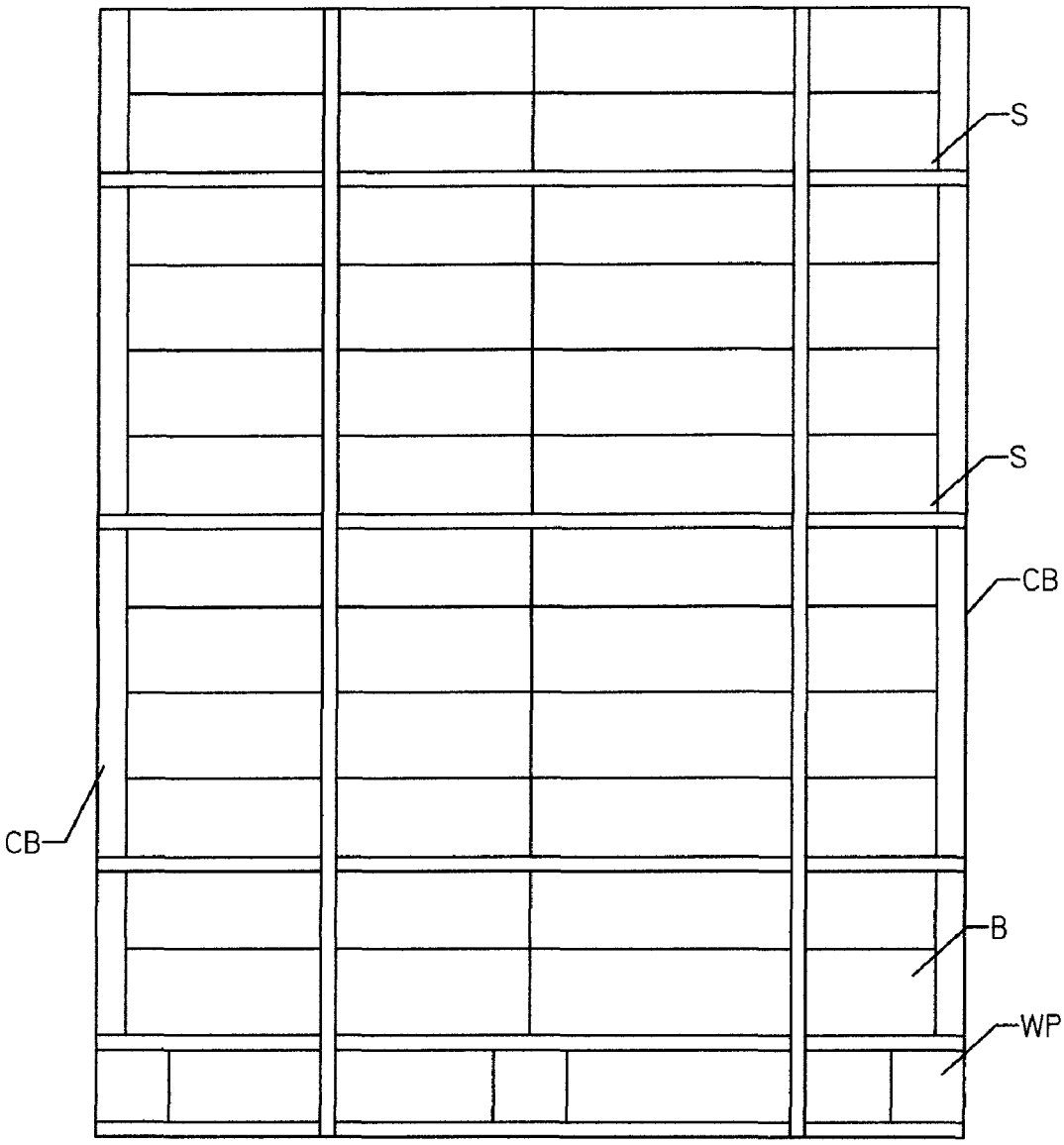
FIG. 9 is a front view of a conventional wooden pallet.

Referring now to FIG. 9, a conventional wooden pallet WP is shown, a load of boxed fruit. The boxes B are held in place by straps S extending around corner boards CB. These extend from the corners of the pallet WP up the corners of the pile of boxes B. The corner boards are a necessary part of the package of fruit on the pallet. They and the pallets should be re-used for their economic use. The pallets can be readily stowed in containers for return to the port of the fruit's despatch.

The corner boards are readily stowed on the pallet of the invention within the posts. The ratchet strap 15,16 holds them tight (as shown in FIG. 6).

For shipment with the fruit, the pallet of the invention can be used as a conventional pallet, including the use of corner boards. The only unconventional feature is the use of strapping under the pallet to hold the bottom two layer of boxes onto the low friction pallet.

For forklift handling, the under surface of the long side members are provided with tab 23 to restrict later sliding off the pallet.

Should it be necessary for several pallets of the invention to be transported together without corner boards, i.e. in non-erected state they can be strapped together with the ratchet strap of the bottom one of them, as shown in FIG. 8.

While the pallet 1, as shown, is made of steel box section, it could be made of any other suitable material, including other metals, plastics materials or wood, which could be used in solid sections or box. The chassis could alternatively be constructed of angle sections secured to corner blocks, typically of wood.

Where the chassis is made of steel box section, it will have low friction, which may result in movement in goods placed thereon. To increase the friction and thus the stability of the goods on the chassis, gripper rods, including teeth may be attached to the chassis, particularly around the side members 2, but also on the dividers 91, 92, 93 and 94.

Figure 10:
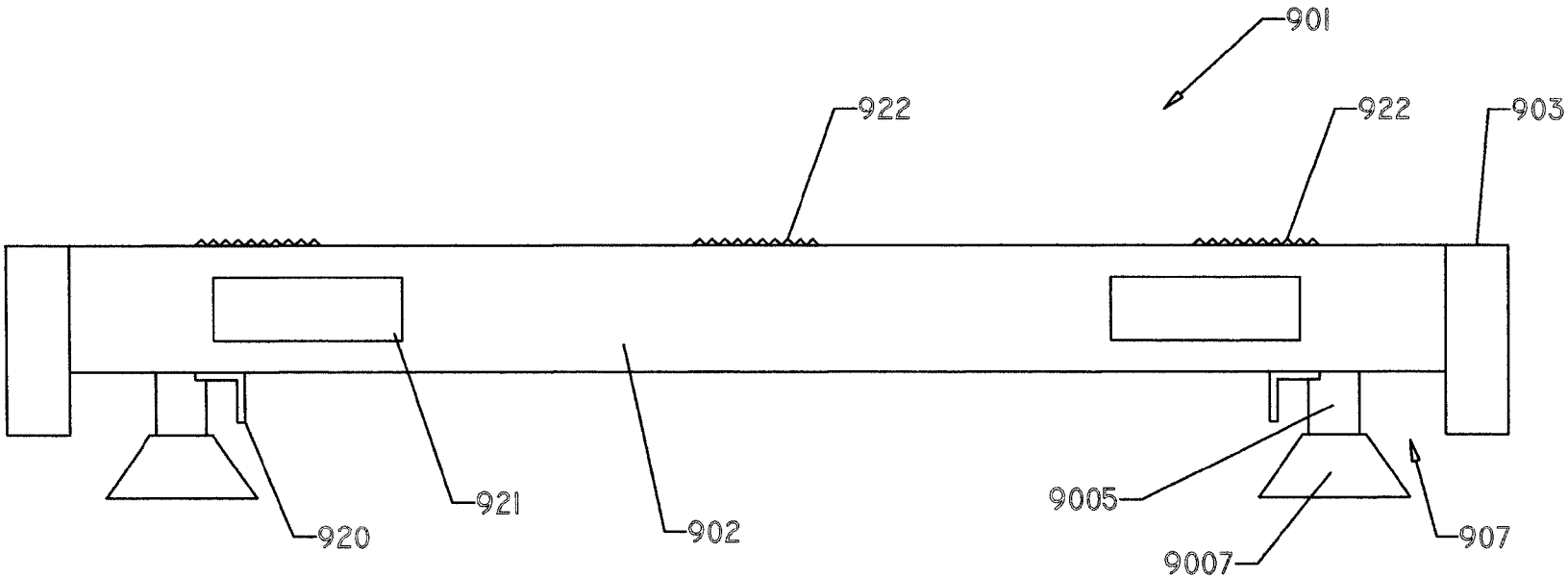
FIG. 10 is a front view of a pallet according to a second aspect of the invention.
Figure 11:
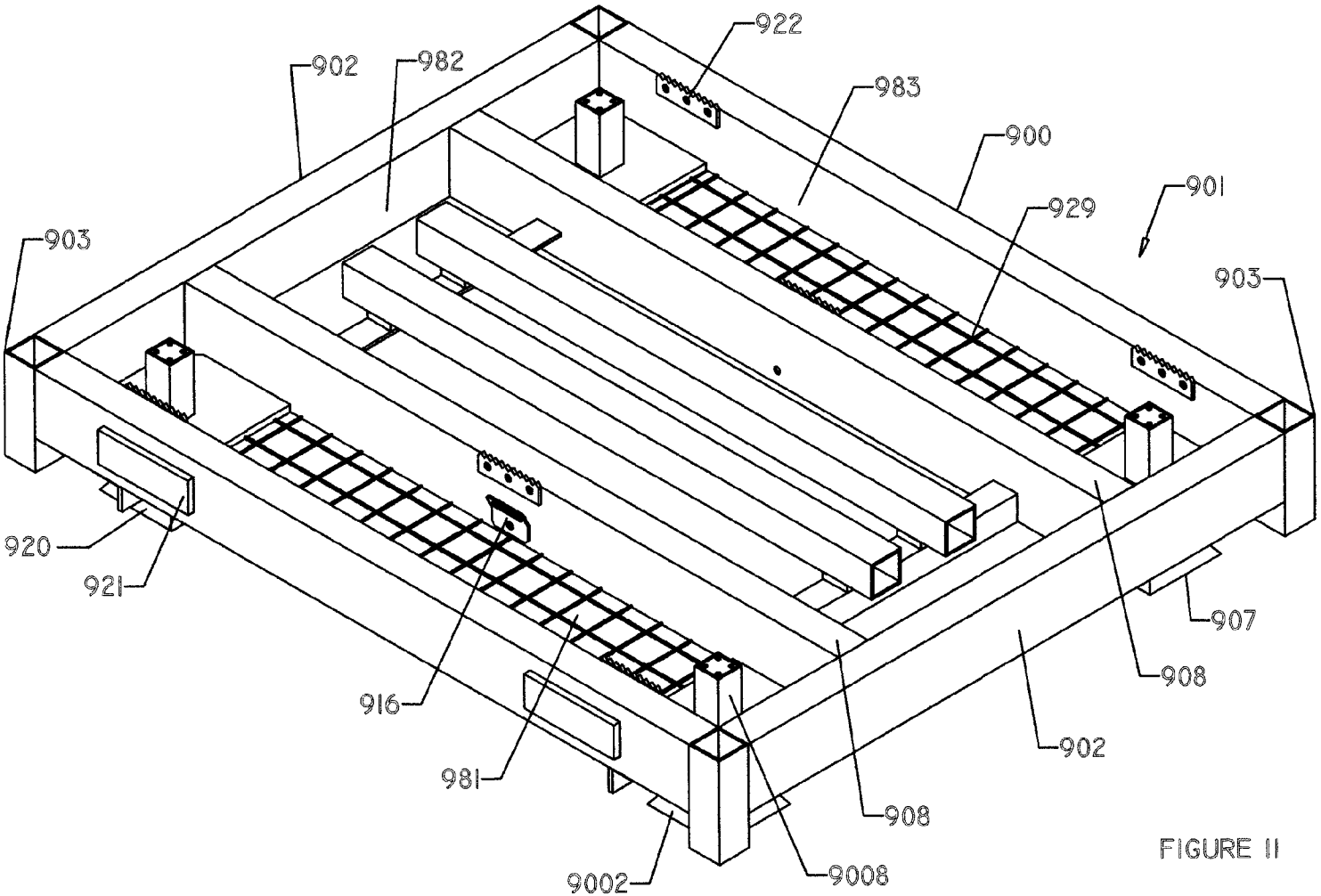
FIG. 11 is a perspective view of the pallet of FIG. 10.
Figure 12:
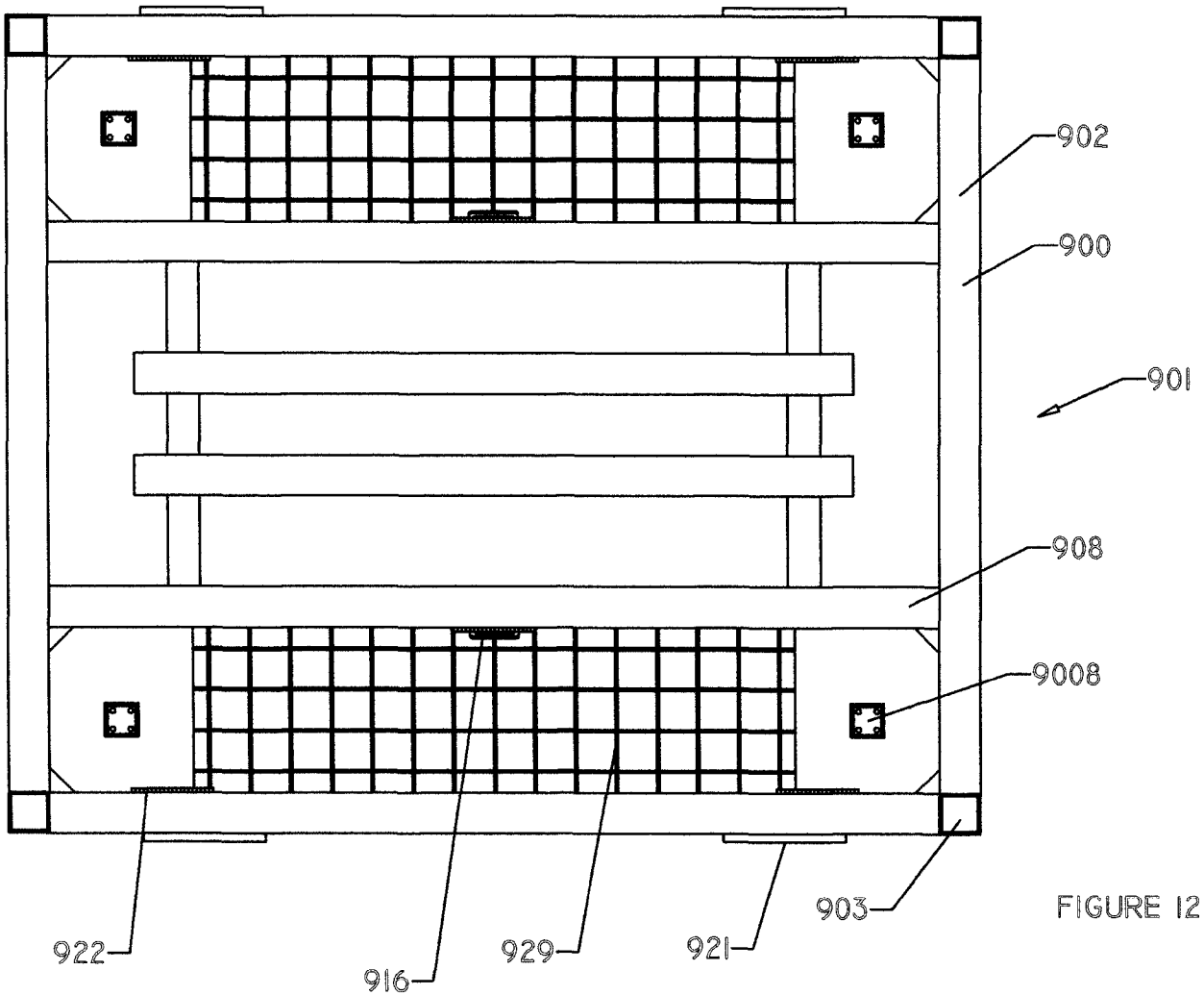
FIG. 12 is a top view of the pallet of FIG. 10.

Referring now to FIGS. 10 to 12, which show a second pallet according to the invention. As in the first embodiments, the frame 900 of the pallet 901 is constructed of steel box cross section, however the pallet may be constructed of any material sufficiently strong to support the goods to be transported thereon. The pallet comprises side members 902, with corner tubes 903 arranged at the corners to provide upwardly open sockets. Set inward of the corner tubes 903 are feet 907, including a lower flared section 9007 and an upper post section 9008, such that in use empty pallets can be stacked one upon another with the flared section 9007 of an upper pallet locating on the post section 9008 of a lower pallet, providing a stable stacking arrangement. The feet provide a space under the frame 900 to allow for the tines of a fork lift truck to move the pallet.

The centre of the pallet is divided into three sections 981, 982 and 983 by members 908. The end sections 981 and 982 provide storage for corner posts (not shown) either side of the upper post section 9008 of the feet 907. The corner posts may be provided with chains attached to the corner tubes 903, or indeed any other part of the frame 901. This helps to minimise loss of the corner posts due to then being mislaid or forgotten.

The base of the end sections, 981, 982 is provided with a grill 929 to allow the storage of any other items, such as a strap, and provide attachment points therefore.

The central section 982 provides storage for cross member supports (not 20 shown). An anchor 916 is provided for the attachment of a strap, when required, on one of the members 908.

In this embodiment sections of gripper teeth 922 are provided on the sides 902 and members 908. These provide grip for the goods placed on the pallet, which will typically be in boxes or on another wooden pallet. In addition guides 920 are secured to the underside of the side members 902, acting as a guide tines of the fork lift truck, and buffer stops 921 are provided on the sides of the side member 902, to act as stops for the fork lift truck providing protection for the pallet and the goods thereon.

The invention is not intended to be restricted to the details of the above-described embodiment. For instance, the pallet can be of any size and dimension, including the stand size of traditional wooden pallet.

Additional retaining bars may be provided on the side members of the chassis, which may be pivotally connected thereto. These can provide additional support for the load on the chassis The cross-members may be welded or otherwise permanently attached between two the corners posts. This provides a unitary structure that may provide additional strength and will be easier to assemble in use.

In addition, the pallet may be provided with detachable wheels for ease of movement, without the need for a fork lift truck. Sockets can be provided on the side members, typically the outer edge of the side members, although the inner edge could be used. The sockets enable the attachment of wheels to the pallet. Typically a socket will be provided with an opening on its underside to receive the upright of a fork supporting a wheel. However, the wheel can be connected to the socket through a variety of well known means.

Additionally, the pallet can be provided with a laterally extending telescopic member for positioning of the pallet at a predetermined distance from a wall or the like for loading of the corner boards at a constant projection from the pallet. This can also be used for the connection of a headboard, where necessary, which can pivot to lie flat against the pallet when not in use.

In other embodiments, the corner posts can be provided to extend telescopically, to give added support for taller loads.

The invention claimed is:

1. A transport pallet comprising:

a chassis having four corners;

the chassis having:

gripper teeth to increase friction to assist in holding goods on the pallet;

guides on its under-surface to guide tines of a fork lift truck;

a base provided with a grill for storage;

feet for supporting the chassis with a lifting fork space beneath the chassis;

corner posts;

upwardly open sockets in each of the four corners of the chassis for receiving the corner posts erectable at the four corners of the chassis;

receptacles in the chassis for the corner posts, the corner posts being completely below the top surface of the chassis when stowed in the receptacles; and straps for strapping a load to the chassis.

2. A transport pallet as claimed in claim 1, wherein the upwardly open sockets receive either lower ends of the posts or the feet of another such pallet stacked on top without the posts being erected.

3. A transport pallet as claimed in claim 1, further comprising cross-members, wherein the corner posts have upper ends adapted to receive the feet of another such pallet stacked on top or engage with the ends of cross-members interconnecting the corner posts in pairs, the cross-members being adapted to receive the feet of another such pallet stacked on top.

4. A transport pallet as claimed in claim 1, wherein interior space of the chassis is divided into a number of slot compartments for the corner posts and the cross-members.

5. A transport pallet as claimed in claim 4, wherein the slots on the one hand and the corner posts and cross-members on the other hand are colour coded to help with stowage in the correct slots.

* * * * *